US010141626B2

(12) United States Patent
Tan et al.

(10) Patent No.: US 10,141,626 B2
(45) **Date of Patent: *Nov. 27, 2018**

(54) ELECTRONIC DEVICE PRINTED CIRCUIT BOARD PATCH ANTENNA

(71) Applicant: Apple Inc., Cupertino, CA (US)

(72) Inventors: Liquan Tan, Sunnyvale, CA (US); Paul X. Wang, Cupertino, CA (US); Rodney A. Gomez Angulo, Sunnyvale, CA (US); Ryan P. Brooks, Menlo Park, CA (US); Umar Azad, San Jose, CA (US); Wing Kong Low, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 613 days.

This patent is subject to a terminal disclaimer.

(21) Appl. No.: 14/339,366

(22) Filed: Jul. 23, 2014

(65) Prior Publication Data

US 2016/0028148 A1 Jan. 28, 2016

(51) Int. Cl.
*H01Q 1/24* (2006.01)
*H01Q 1/22* (2006.01)
(Continued)

(52) U.S. Cl.
CPC ..... *H01Q 1/22* (2013.01); *H01Q 1/243* (2013.01); *H01Q 1/44* (2013.01); *H01Q 1/48* (2013.01); *H01Q 9/0407* (2013.01)

(58) Field of Classification Search
CPC ..... H01Q 1/48; H01Q 1/44; H01Q 9/0407; H01Q 1/243; H01Q 1/22
See application file for complete search history.

(56) References Cited

U.S. PATENT DOCUMENTS 5,652,595 A 11/1997 Ahrens et al.
6,646,610 B2 11/2003 Troelsen
(Continued)

FOREIGN PATENT DOCUMENTS

EP 2311138 8/2012
KR 10-2007-0122090 12/2007
(Continued)

OTHER PUBLICATIONS

Yong et al., U.S. Appl. No. 14/306,024, filed Jun. 16, 2014.

*Primary Examiner* — Trinh Dinh
(74) *Attorney, Agent, or Firm* — Treyz Law Group, P.C.; Michael H. Lyons; Tianyi He

(57) ABSTRACT

An electronic device may be provided with wireless circuitry that includes a radio-frequency transceiver circuit and an antenna. The antenna may be a patch antenna formed from a patch antenna resonating element and an antenna ground. The patch antenna resonating element may be formed from a metal patch on a printed circuit board. The antenna ground may be formed from a metal housing having a planar rear wall that lies in a plane parallel to the metal patch. The radio-frequency transceiver circuit may be coupled to the metal patch through traces on the printed circuit and may be coupled to rear wall of the housing through a screw and a screw boss in the housing. Buttons and other electrical components may be mounted on the printed circuit board and may be coupled to control circuitry on the printed circuit board through the metal patch.

18 Claims, 13 Drawing Sheets

(51) Int. Cl.

| | |
|---|---|
| ***H01Q 1/48*** | (2006.01) |
| ***H01Q 9/04*** | (2006.01) |
| ***H01Q 1/44*** | (2006.01) |

(56) References Cited

U.S. PATENT DOCUMENTS

| | | | | |
|---|---|---|---|---|
| 6,812,898 | B2 | 11/2004 | Doub et al. | |
| 7,280,075 | B2 * | 10/2007 | Koyama | H01Q 1/2283 343/702 |
| 7,616,163 | B2 | 11/2009 | Montgomery et al. | |
| 7,671,803 | B2 | 3/2010 | Neill et al. | |
| 8,060,029 | B2 | 11/2011 | Rofougaran | |
| 8,611,953 | B2 | 12/2013 | Jordan et al. | |
| 2004/0090368 | A1 * | 5/2004 | Channabasappa | H01Q 1/523 343/700 MS |
| 2007/0080865 | A1 * | 4/2007 | Huang | H01Q 1/243 343/700 MS |
| 2011/0006954 | A1 * | 1/2011 | Seo | H01Q 1/243 343/702 |
| 2011/0050508 | A1 * | 3/2011 | Guterman | H01Q 1/2266 343/702 |
| 2011/0291896 | A1 * | 12/2011 | Pascolini | H01Q 1/243 343/702 |
| 2012/0019423 | A1 * | 1/2012 | Schultheiss | G01F 23/284 343/753 |
| 2012/0050114 | A1 * | 3/2012 | Li | H01Q 1/2266 343/702 |
| 2012/0214412 | A1 | 8/2012 | Schlub et al. | |
| 2013/0050046 | A1 * | 2/2013 | Jarvis | H01Q 1/243 343/852 |
| 2013/0079069 | A1 * | 3/2013 | Kwon | H01Q 1/243 455/575.5 |
| 2013/0149975 | A1 * | 6/2013 | Yu | H04B 7/0602 455/78 |
| 2013/0223836 | A1 * | 8/2013 | Gibbs | H01Q 9/42 396/535 |
| 2013/0241780 | A1 | 9/2013 | Amm et al. | |
| 2013/0300618 | A1 | 11/2013 | Yarga et al. | |
| 2014/0139047 | A1 * | 5/2014 | Haines | H01H 9/56 307/140 |
| 2014/0159989 | A1 | 6/2014 | Malek et al. | |
| 2014/0340265 | A1 * | 11/2014 | Vazquez | H01Q 9/42 343/702 |
| 2015/0077624 | A1 * | 3/2015 | Havskjold | H05K 1/028 348/373 |
| 2015/0364815 | A1 * | 12/2015 | Yong | H01Q 9/0407 343/702 |
| 2017/0186577 | A1 * | 6/2017 | Haines | H01H 9/56 |

FOREIGN PATENT DOCUMENTS

| | | |
|---|---|---|
| KR | 10-2012-0033904 | 4/2012 |
| KR | 10-2013-0032545 | 4/2013 |
| KR | 10-2013-0040891 | 4/2013 |
| KR | 10-2013-0097661 | 9/2013 |
| KR | 10-2013-0118919 | 10/2013 |

* cited by examiner

ELECTRONIC DEVICE PRINTED CIRCUIT BOARD PATCH ANTENNA

BACKGROUND

This relates generally to electronic devices and, more particularly, to electronic devices with wireless communications circuitry.

Electronic devices often include wireless communications circuitry. Radio-frequency transceivers are coupled to antennas to support communications with external equipment. During operation, a radio-frequency transceiver uses an antenna to transmit and receive wireless signals.

It can be challenging to incorporate wireless components such as antenna structures within an electronic device. If care is not taken, an antenna may consume more space within a device than desired, may exhibit unsatisfactory wireless performance, or may interfere with the operation of control circuitry in a device.

It would therefore be desirable to be able to provide improved antennas for electronic devices.

SUMMARY

An electronic device may be provided with wireless circuitry. The electronic device may be a remote control or other device that uses wireless communications to interact with external electronic equipment. Buttons, a touch pad, and other input-output devices in the remote control may be used to gather input from a user.

The wireless circuitry may include a radio-frequency transceiver circuit and an antenna. The antenna may be a patch antenna formed from a patch antenna resonating element and an antenna ground. The patch antenna resonating element may be formed from a metal patch on a printed circuit board. The metal patch may be a rectangular patch formed from a patterned metal trace on the printed circuit board. A transmission line formed from portions of metal traces on the printed circuit board may be coupled to the patch antenna resonating element. Slots may be provided in the patch to help the patch antenna match the impedance of the transmission line.

The antenna ground may be formed from a metal housing such as a metal housing having a planar rear wall that lies in a plane parallel to the metal patch. Components for the remote control or other device may be mounted in the housing. For example, the touch pad may be mounted in the housing, the printed circuit may be mounted in the housing, buttons may be mounted in the housing, a battery may be mounted in the housing, and other circuitry may be mounted in the housing.

A plastic shim or other dielectric structure may be used to maintain a flexible printed circuit at a desired distance from the metal patch. The flexible primed circuit may be coupled to the touch pad. A glass layer or other dielectric structure may be mounted on the front face of the housing and may cover the patch antenna resonating element and other structures on the printed circuit board.

The radio-frequency transceiver circuit may be coupled to the metal patch through traces on the printed circuit and may be coupled to rear wall of the housing through a screw and a screw boss in the housing. Buttons and other electrical components may be mounted on the printed circuit board and may be coupled to control circuitry on the printed circuit board through the metal patch. Inductors may be interposed in signal paths between the control circuitry and the buttons to block radio-frequency signals from the radio-frequency transceiver circuit. A dielectric support structure such as a plastic support structure with an array of recesses may be interposed between the printed circuit board and the rear wall of the metal housing.

DETAILED DESCRIPTION

Figure 1:
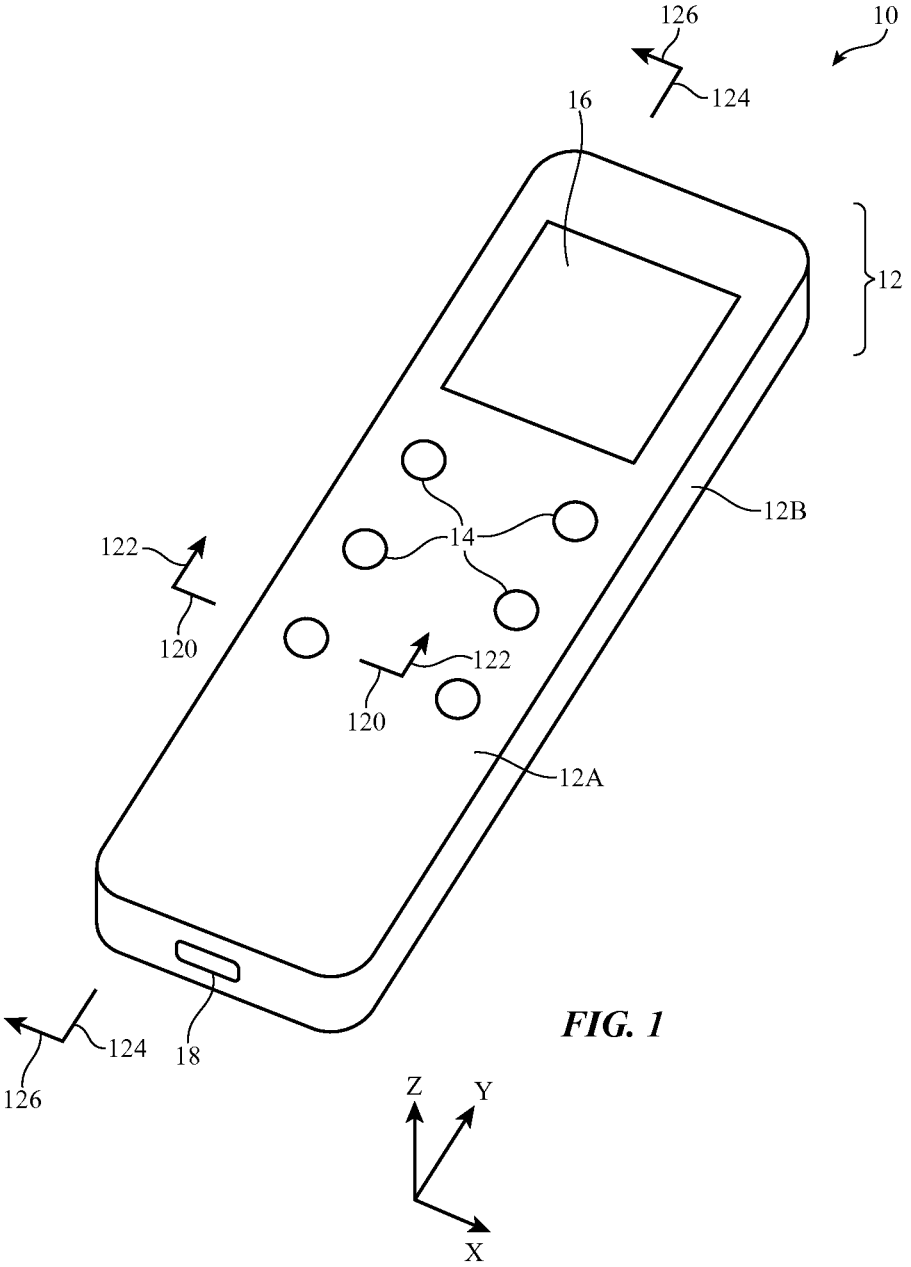
FIG. 1 is a perspective view of an illustrative electronic device with wireless communications circuitry in accordance with an embodiment.

An electronic device such as electronic device 10 of FIG. 1 may contain wireless circuitry. The wireless circuitry may be used to wirelessly communicate with external equipment such as a computer, a television, a set-top box, a media player, a display, a wearable device, a cellular telephone, or other electronic equipment. Electronic device 10 may be a remote control or other electronic device (e.g., a portable device, a computing device, an accessory for controlling a computer such as a wireless trackpad or wireless mouse, etc.). Illustrative configurations for device 10 in which device 10 includes components that allow device 10 to serve as a remote control for controlling external equipment are sometimes described herein as an example. This is, however, merely illustrative. Device 10 may be any suitable electronic equipment.

Device 10 may contain wireless communications circuitry that operates in long-range communications bands such as cellular telephone bands and wireless circuitry that operates in short-range communications bands such as the 2.4 GHz Bluetooth® band and the 2.4 GHz and 5 GHz WiFi® wireless local area network bands (sometimes referred to as IEEE 802.11 bands or wireless local area network communications bands). Device 10 may also contain wireless communications circuitry for implementing near-field communications, light-based wireless communications (e.g., infrared light communications and/or visible light communications), satellite navigation system communications, or other wireless communications. Illustrative configurations for the wireless circuitry of device 10 in which wireless communications are performed over a 2.4 GHz communications band (e.g., a Bluetooth® or WiFi® link) are sometimes described herein as an example.

As shown in FIG. 1, device 10 may have a housing such as housing 12. Housing 12, which may sometimes be referred to as an enclosure or case, may be formed of plastic, glass, ceramics, fiber composites, metal (e.g., stainless steel aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.). With one illustrative configuration, housing 12 may include a rear portion such as portion 12B and a front portion such as front portion 12A. Rear portion 12B may include a rear wall (e.g., a planar wall) and four sidewalls that run along each of the four edges of the rear wall. The sidewalls may be curved, may be planar, or may have other suitable shapes. The sidewalls of the rear portion of housing 12 may, if desired, form smooth continuously extending portions of rear housing 12B. Configurations for device 10 in which the sidewalls for housing 12 extend vertically upwards (dimension Z in the diagram of FIG. 1) may also be used.

Front housing portion 12A may extend over some or all of the front surface of housing 12, as shown in FIG. 1. Housing portion 12A may be formed from plastic or other suitable materials (e.g., one or more different plastics, a single plastic, plastic and metal, glass, etc.). The use of a dielectric material such as a layer of glass or plastic to cover the front of housing 12 (i.e., to form front face housing portion 12A) allows wireless signals to be transmitted and received through the front of housing 12. The use of metal to form rear portion 12B of housing 12 allows rear portion 12B to serve as part of the circuitry of device 10. For example, rear portion 12B may serve as antenna ground in an antenna for device 10.

Device 10 may include buttons such as buttons 14. There may be any suitable number of buttons 14 in device 10 (e.g., a single button 14, more than one button 14, two or more buttons 14, five or more buttons 14, six or more buttons 14, etc.). Buttons 14 may be formed from dome switches or other switches mounted in housing 12. Button members for buttons 14 may be formed from glass, plastic, or other materials and may press against the dome switches or other switches mounted in housing 12.

Buttons 14 may be organized to form a directional pad (D-pad) or other control pad, may include up and down buttons, may be arranged to allow control of functions such as media volume, channel selection, page up and down, menu back/forward, playback reverse, pause, stop, and forward, fast forwards and fast reverse, time period skip, cancel, enter etc., may include number keys and/or letter keys, may be associated with dedicated functions for a set-top box, television, or other equipment may include a power button for turning off and turning on remote equipment, or may have other suitable functions. The six-button layout of FIG. 1 is merely illustrative.

If desired, device 10 may include one or more input-output devices such as input-output device 16. Input-output device 16 may include a display such as a liquid crystal display, organic light-emitting diode display, electrophoretic display, or other visual output component. Alternatively, or in combination with a visual output component, input-output device 16 may include a touch sensor. For example, input-output device 16 may be a touch pad or other component that incorporates a touch sensor array to gather touch input from a user. A user may, for example, supply touch input using one or more fingers. Touch input may include single-linger commands and/or multi-finger gestures (e.g., swipes, pinch to zoom commands, etc.). The touch sensor array of device 16 may include a capacitive touch sensor array (i.e., device 16 may be a capacitive touch sensor forming a touch pad) or may include touch sensor components based on other touch technologies (e.g., resistive touch, acoustic touch, force-based touch, light-based touch, etc.).

Connector ports such as port 18 may be configured to receive plugs on external cables and other accessories. Port 18 may, for example, contain a connector that mates with a connector on the end of a digital data cable.

Figure 2:
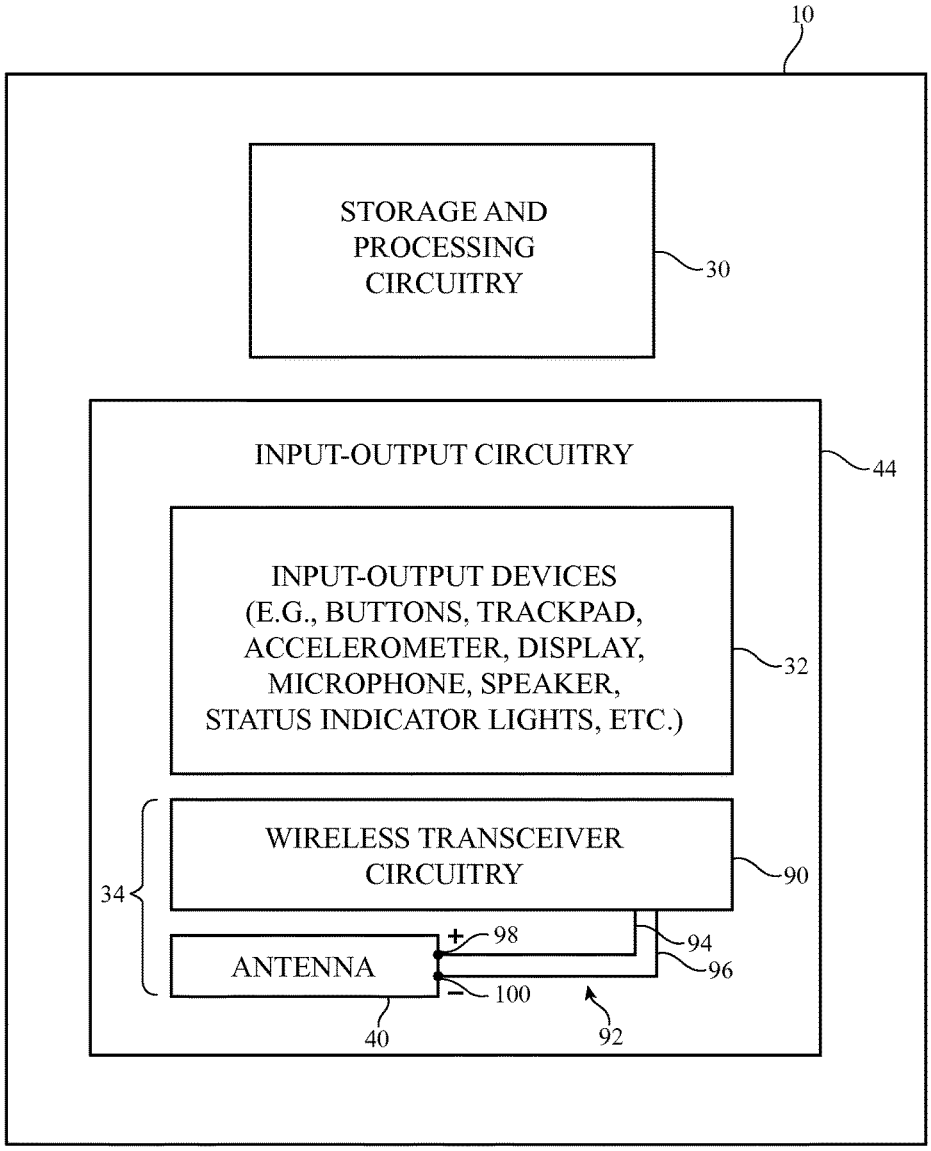
FIG. 2 is a schematic diagram of an illustrative electronic device with wireless communications circuitry in accordance with an embodiment.

A schematic diagram showing illustrative components that may be used in device 10 is shown in FIG. 2. As shown in FIG. 2, device 10 may include control circuitry such as storage and processing circuitry 30. Storage and processing circuitry 30 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 30 may be used to control the operation of device 10. This processing circuitry may be based on one or more microprocessors, microcontrollers, digital signal processors, baseband processor integrated circuits, application specific integrated circuits, etc.

Storage and processing circuitry 30 may be used to run software on device 10. For example, software running on device 10 may be used to process input commands from a user that are supplied using input-output components such as buttons 14, touch pad (track pad) 16, and other input-output circuitry. To support interactions with external equipment, storage and processing circuitry 30 may be used in implementing communications protocols. Communications protocols that may be implemented using storage and processing circuitry 30 include internet protocols, wireless local area network protocols (e.g., IEEE 802.11 protocols—sometimes referred to as WiFi®), protocols for other short-range wireless communications links such as the Bluetooth® protocol, etc.

Device 10 may include input-output circuitry 44. Input-output circuitry 44 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices may include touch screens, displays without touch sensor capabilities, buttons (e.g., buttons 14), joysticks, scrolling wheels, touch pads (e.g., touch pad 16), key pads, keyboards, microphones, cameras, buttons, speakers, status indicators, light sources, audio jacks and other audio port components, digital data port devices, light sensors, motion sensors (accelerometers), capacitance sensors, proximity sensors (e.g., a capacitive proximity sensor and/or an infrared proximity sensor), magnetic sensors, and other sensors and input-output components.

Input-output circuitry 44 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include wireless local area network transceiver circuitry that may handle 2.4 GHz and 5 GHz bands for WiFi® (IEEE 802.11) communications, wireless transceiver circuitry that may handle the 2.4 GHz Bluetooth® communications band, cellular telephone transceiver circuitry for handling wireless communications in communications bands between 700 MHz and 2700 MHz or other suitable frequencies (as examples), or other wireless communications circuits. If desired, wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NEC) circuitry, satellite navigation system receiver circuitry, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles. To conserve power, it may be desirable in some embodiments to configure wireless communications circuitry 34 so that transceiver 90 handles exclusively short-range wireless links such as 2.4 GHz links (e.g., Bluetooth® and/or WiFi® links). Other configurations may be used for wireless circuitry 34 if desired (e.g., configurations with coverage in additional communications bands).

Wireless communications circuitry 34 may include one or more antennas such as antenna 40. Antenna 40 may be formed using any suitable antenna type. For example, antenna 40 may be an antenna with a resonating element that is formed from loop antenna structures, patch antenna structures, inverted-F antenna structures, slot antenna structures, planar inverted-F antenna structures, helical antenna structures, hybrids of these designs, etc. If desired, antenna 40 may be a cavity-backed antenna (e.g., an antenna in which the ground plane has the shape of a cavity). Patch antenna structures may be configured to exhibit lateral antenna currents that help enhance polarization insensitivity and help reduce directional sensitivity.

Transmission line paths such as transmission line 92 may be used to couple antenna 40 to transceiver circuitry 90. Transmission line 92 may be coupled to antenna feed structures associated with antenna structures 40. As an example, antenna structures 40 may form as patch antenna or other type of antenna having an antenna feed with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 92. Other types of antenna feed arrangements may be used if desired. The illustrative feeding configuration of FIG. 2 is merely illustrative. Transmission line 92 may include coaxial cable paths, microstrip transmission lines, stripline transmission lines, edge-coupled microstrip transmission lines, edge-coupled stripline transmission lines, transmission lines formed from combinations of transmission lines of these types, etc. Filter circuitry, switching circuitry, impedance matching circuitry, and other circuitry may be interposed within the transmission lines, if desired. Circuits for impedance matching circuitry may be formed from discrete components (e.g., surface mount technology components) or may be formed from housing structures, printed circuit board structures, traces on plastic supports, etc. Components such as these may also be used in forming filter circuitry.

Figure 3:
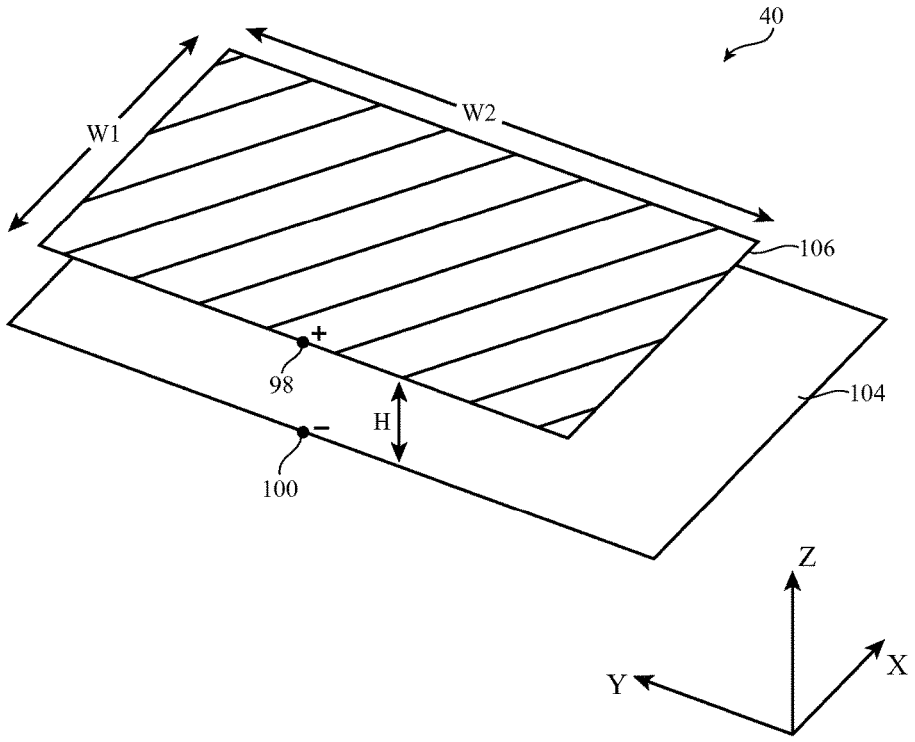
FIG. 3 is a perspective view of an illustrative antenna in accordance with an embodiment.

FIG. 3 is a diagram of illustrative patch antenna structures that may be used in implementing antenna 40 for device 10. Patch antenna 40 of FIG. 3 has an antenna resonating element such as patch antenna resonating element 106 and antenna ground (ground plane) 104. Resonating element 106 may be formed from metal traces on a printed circuit, metal foil, or other conductive structures. Resonating element 106 may lie in a plane that is parallel to ground plane 104. Ground plane 104 may be formed using metal traces on a printed circuit, metal device housing structures such as a metal rear housing wall in a housing that is partly or completely formed from metal, or may be formed from other antenna ground structures. For example, ground plane 104 may be formed from a metal rear housing wall that lies in a plane that is parallel to a plane containing patch antenna resonating element 106.

Antenna resonating element 106 may have a rectangular shape or other planar (patch) shape and may lie in the horizontal (X-Y) plane of FIG. 3. Resonating element 106 may have lateral dimensions W1 and W2. The values of dimensions W1 and W2 may be selected to be a half of a wavelength at an operating frequency of interest (to help enhance antenna efficiency) or may be less than a half of a wavelength in length (to help minimize the size of device 10). A half of a wavelength at 2.4 GHz is about 2.5 inches.

Axis Y of FIG. 3 may form the longitudinal axis of resonating element 106 and may also serve as the longitudinal axis of device 10 and housing 12 (see, e.g., FIG. 1). The size of patch resonating element 106 of FIG. 3 in dimension X (e.g., width W1) may be substantially equal to the width of device 10. The size of element 106 in dimension Y (e.g., dimension W2) may be equal to the length of housing 12 or may be less than the length of housing 12 (e.g., 70% or less, 50% or less, etc.). A vertical distance such as height H may separate resonating element patch 106 from antenna ground 104 in vertical dimension Z. The magnitude of H may be 2-3 mm, 1-5 mm or other suitable size.

With one suitable arrangement, antenna resonating element patch 106 may be formed from traces on a printed circuit. The traces may form a direct-current (DC) ground for integrated circuits and electrical components on the printed circuit (i.e., a DC ground). The same traces (i.e., the DC ground) may form antenna resonating element patch 106. Antenna 40 may have an antenna feed formed from positive antenna feed terminal 98 and ground antenna feed terminal 100. Positive antenna feed terminal 98 may be coupled to resonating element patch 106. Ground antenna feed terminal 100 may be coupled to antenna ground 104.

Buttons 14 may include button members in respective openings of front wall 12A of housing 12. Front housing portion 12A may, for example, have circular openings in which circular plastic or glass button members move when pressed by a user. Each button member may be associated with a respective electrical switch such as a dome switch or other suitable switch.

Figure 4:
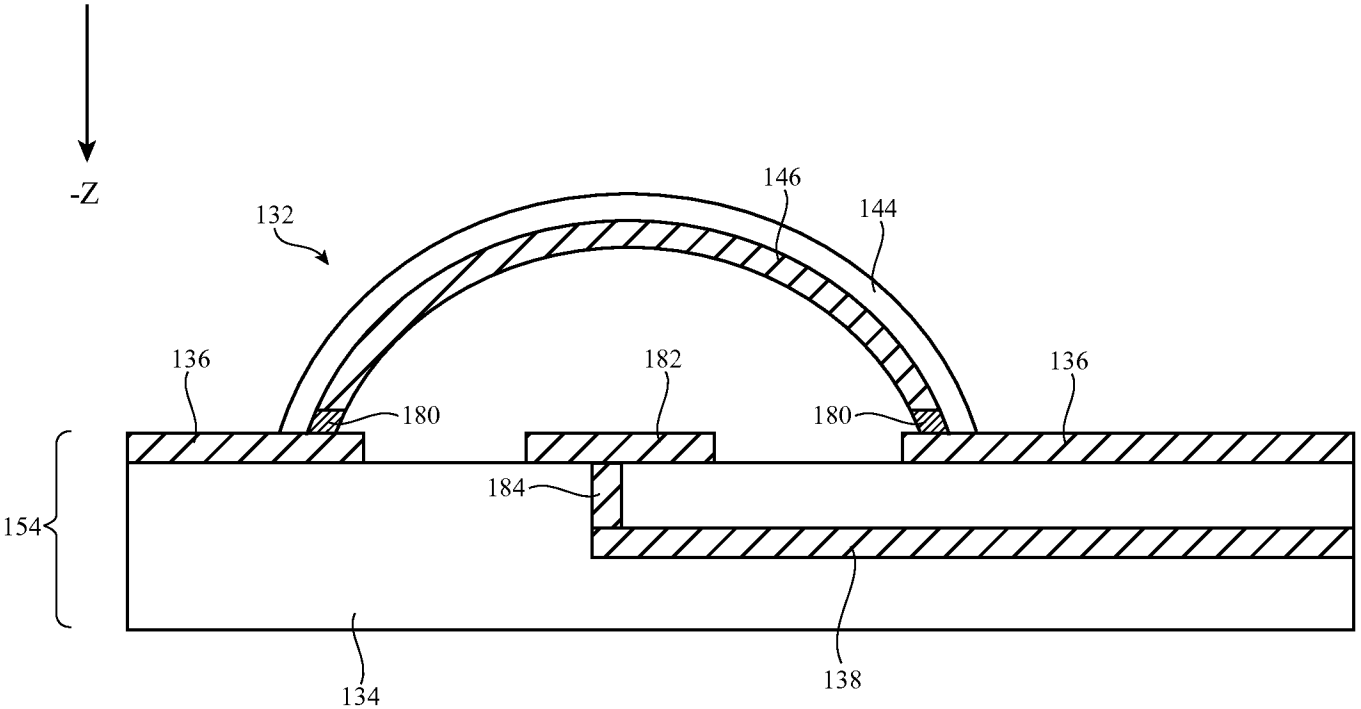
FIG. 4 is a cross-sectional side view of an illustrative dome switch in accordance with an embodiment.

A cross-sectional side view of an illustrative dome switch is shown in FIG. 4. As shown in FIG. 4, dome switch 132 may have a compressible dome member such as member 144. Member 144 may be formed from a material such as plastic. During operation, a user may press downwards in direction −Z on a button member that compresses member 144. This causes member 144 to collapse against the upper surface of printed circuit 154. A metal sheet or coating such as metal coating 146 may be formed on the inner surface of dome member 144. The metal coating may be shorted to metal layer 136 on printed circuit substrate 134 in printed circuit 154 using solder 180 or other electrical coupling mechanism (i.e., in the open state for button 14, metal coating layer 146 may be shorted to the outer electrode of switch 132). When compressed downwards, coating 146 may short central dome switch electrode 182 to the outer electrode formed from layer 136. Central electrode 182 may be coupled to metal via 184 and horizontal signal trace 138. Trace 138 and metal layer 136 may be coupled to button controller circuitry in storage and processing circuitry 30 (FIG. 2).

Figure 5:
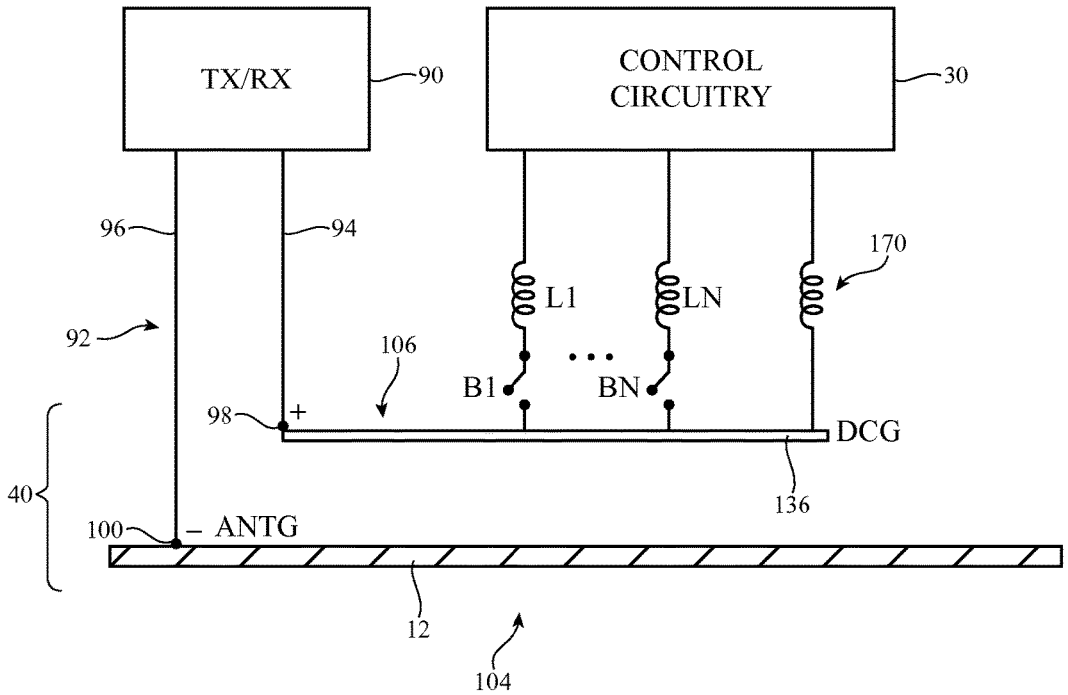
FIG. 5 is a diagram showing how radio-frequency transceiver circuitry and control circuits in an electronic device may be coupled to metal structures in an electronic device in accordance with an embodiment.

Control circuitry 30 and wireless transceiver circuitry 90 may be coupled to metal traces 136 using circuitry of the type shown in FIG. 5. As shown in FIG. 5, control circuitry 30 may be coupled to buttons 14 (e.g., buttons B1 . . . BN) using respective inductors L1 . . . LN. Inductor 170 may be coupled directly to metal layer 136. When a given switch is depressed, the switch will be closed and will form a short circuit through the inductor associated with the given switch, through the given switch, through metal layer 136, and through the path containing inductor 170. Inductors L1 . . . LN and inductor 170 may serve as low pass filters that prevent high-frequency signals such as radio-frequency signals associated with operation of transceiver circuitry 90 and antenna 40 from interfering with the operation of control circuitry 30. Metal layer 136 may have the shape of patch antenna resonating element 106 of FIG. 3 (e.g., a rectangular patch shape that fits within housing 12) or may have other suitable shapes. Layer 136 may serve both as antenna resonating element 106 and as DC ground (DCG) for control circuitry 30 and buttons 14.

Wireless radio-frequency transceiver circuitry 90 may be coupled to antenna 40 using transmission line 92. Transmission line 92 may have a positive signal path such as path 94 that is coupled to positive antenna feed terminal 98 of antenna 40. Transmission line 92 may also have a ground signal path such as path 96 that is coupled to ground antenna feed terminal 100. Terminal 98 may be coupled to antenna resonating element 106, which is formed from metal layer 136. Terminal 100 may be coupled to antenna ground (ANTG), which is formed from metal housing 12 or other structure for forming antenna ground plane 104.

Figure 6:
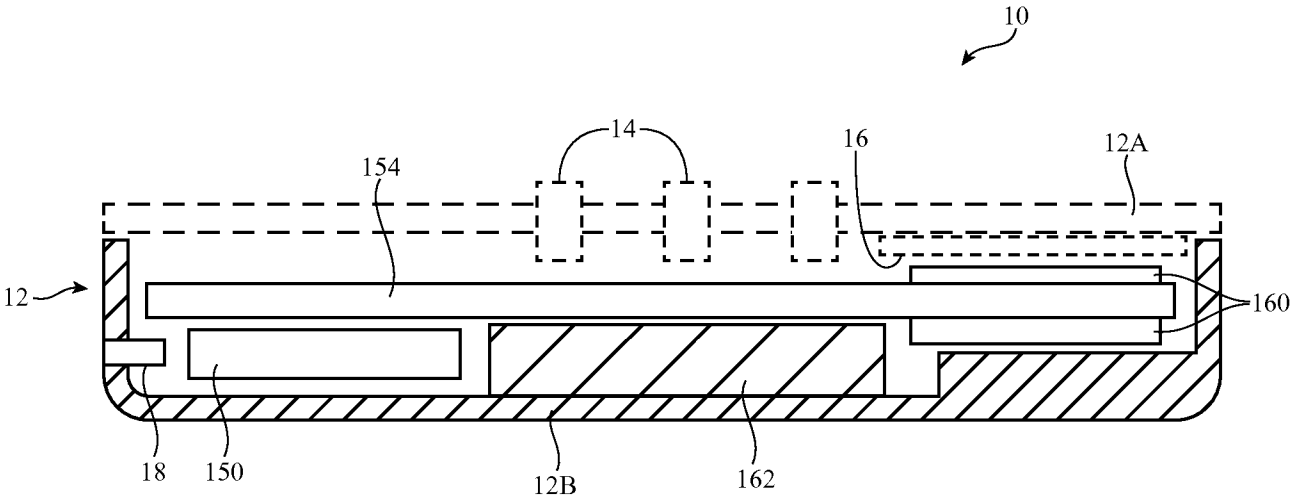
FIG. 6 is a cross-sectional side view of an illustrative electronic device in accordance with an embodiment.

FIG. 6 is a cross-sectional side view of device 10 of FIG. 1 taken along line 124 and viewed in direction 126 of FIG. 1. As shown in FIG. 6, components such as buttons 14 and touch pad 16 or other input-output devices that are operated by a user of device 10 may be mounted in housing 12 along the front of device 10 (i.e., the upper surface of device 10 that is formed by housing wall 12A). A flexible printed circuit cable or other signal paths may be used to couple battery 150 and other components in device 10 to printed circuit 154. Flexible printed circuit cables may be coupled to metal traces in printed circuit 154 using board-to-board connectors or other coupling mechanisms.

Integrated circuits and other components (see, e.g., components 160, which may form control circuitry 30 and input-output circuitry 44 such as transceiver 90) may be mounted on the upper and lower surfaces of printed circuit 154 using solder. Dielectric carrier 162 (e.g., a foam support structure or a support structure formed from hollow molded plastic or other dielectric materials) may be mounted to housing 12 and may be used to support printed circuit 154 under buttons 14.

Figure 7:
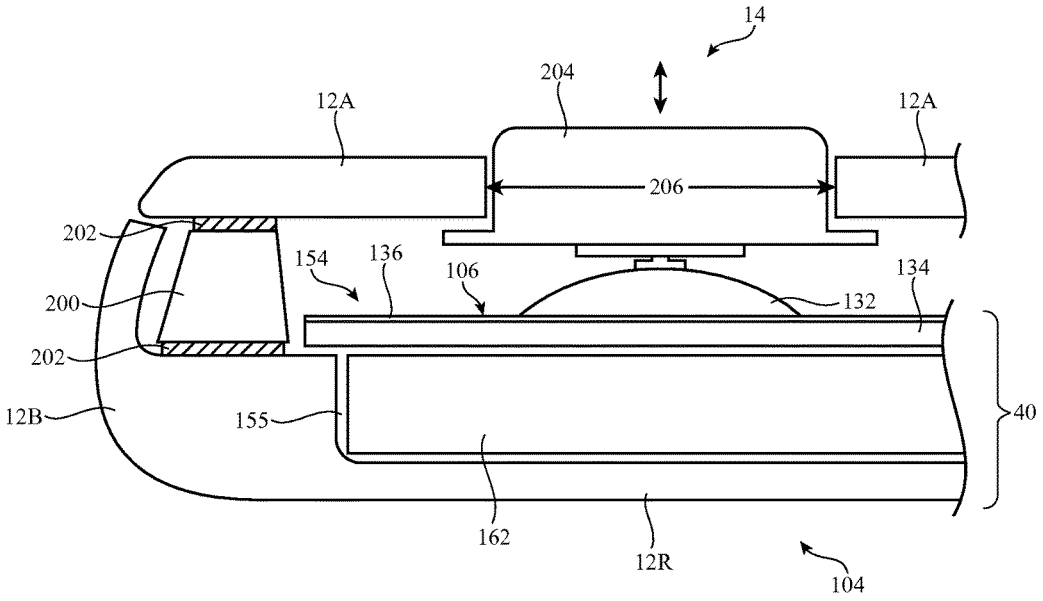
FIG. 7 is a cross-sectional side view of a button and associated structures in an electronic device in accordance with an embodiment.

A cross-sectional view of device 10 taken along line 120 and viewed in direction 122 of FIG. 1 is shown in FIG. 7. As shown in FIG. 7, patch antenna 40 may be formed from antenna resonating element 106 and antenna ground 104. Antenna resonating element 106 may be formed from metal trace(s) 136. Metal traces 136 may be formed from one or more metal layers on a printed circuit substrate. As shown in FIG. 7, for example, metal traces 136 may be formed on the uppermost layer of printed circuit substrate 134 in printed circuit 154. Printed circuit 154 may be a rigid printed circuit board (e.g., printed circuit substrate 134 may be formed from a rigid printed circuit board material such as fiberglass-filled epoxy) or may be a flexible printed circuit (e.g., printed circuit substrate 134 may be formed from a sheet of polyimide or other flexible polymer layer).

Antenna ground 104 may be formed from metal device structures such as a metal housing (e.g., a metal housing 12 having metal rear housing wall 12R). Metal rear housing wall 12R may be a planar metal structure that lies in a plane parallel to the plane of metal traces 136. Dielectric-filled cavity 155 (e.g., a space filled with air, plastic, foam, or other dielectric materials) may be interposed between resonating element 106 and metal rear housing wall 12R and may separate resonating element 106 from metal rear housing wall 12R. During operation of antenna 40, antenna signals may establish electric fields extending between antenna ground 104 and resonating element 105.

Antenna resonating element 106 may be formed from metal or other conductive material. In configurations of the type shown in FIG. 7 in which antenna resonating element 106 is formed from metal traces 136 in a printed circuit such as printed circuit 154, metal traces 136 may serve both to form antenna resonating element 106 and to form a direct-current (DC) ground for non-radio-frequency circuitry in device 10. As an example, metal traces 135 may serve to carry DC button signals associated with buttons such as button 14 to control circuitry 30 in device 10. Each button 14 may have an associated switch 132 that is electrically coupled to metal layer 136. Switches such as switch 132 of FIG. 4 may be dome switches or other switches that are covered with a protective layer such as a layer of plastic. As shown in FIG. 4, each button 14 may have a button member such as button member 204 that moves vertically within an opening 206 (e.g., a circular hole or a hole of other suitable shape) in front housing portion 12A. Front housing portion 12A may be formed from a sheet of glass, from a layer of plastic, or from other dielectric structures to allow antenna 40 (i.e., dielectric that does not block signals associated with antenna 40). If desired, glass layer 12A may be attached to housing 12B of device 10 using adhesive 202 and optional structures such as structure 200 (e.g., an internal metal frame, a plastic support structure, etc.).

Figure 8:
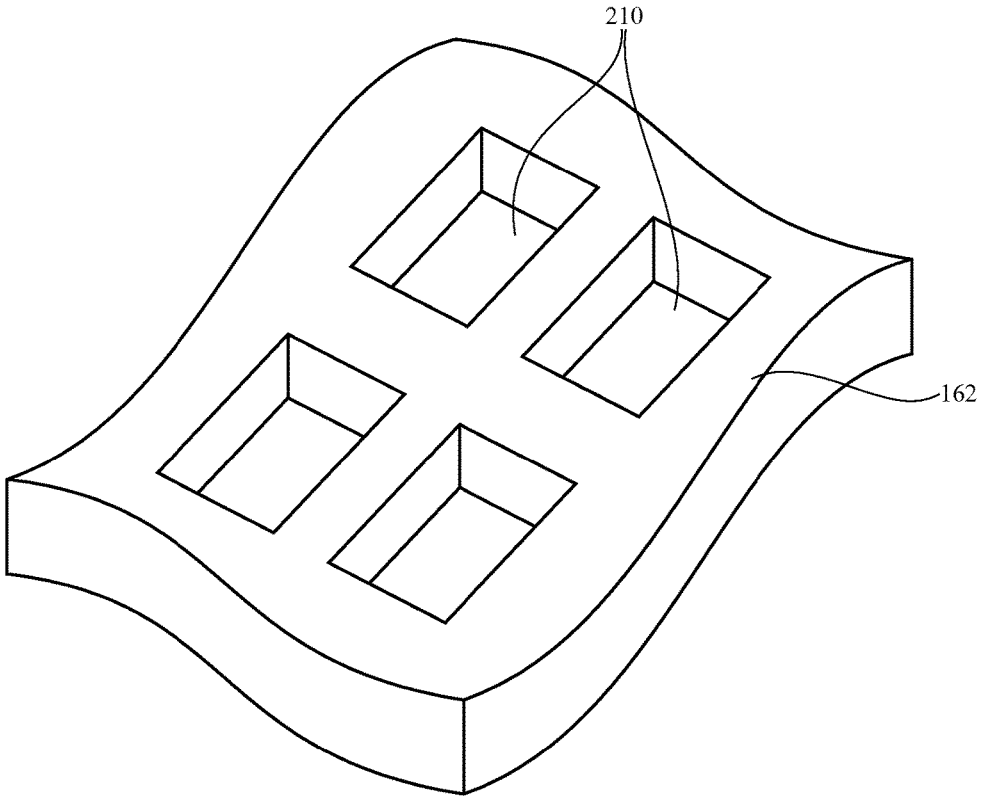
FIG. 8 is a perspective view of a portion of a plastic support structure in accordance with an embodiment.

It may be desirable to form one or more openings in support structure 162 to reduce antenna losses and thereby enhance performance for antenna 40. As an example, support structure 162 may be provided with openings such as openings 210 of FIG. 8. Openings 210 may be box-shaped cavities, may be recesses with curved edges, may be recesses with straight edges or a combination of straight and curved edges, or may have any other suitable shape. Openings 210 may form an array of depressions (e.g., an array of recesses containing multiple rows and columns) or may include randomly distributed depressions or other openings.

Figure 9:
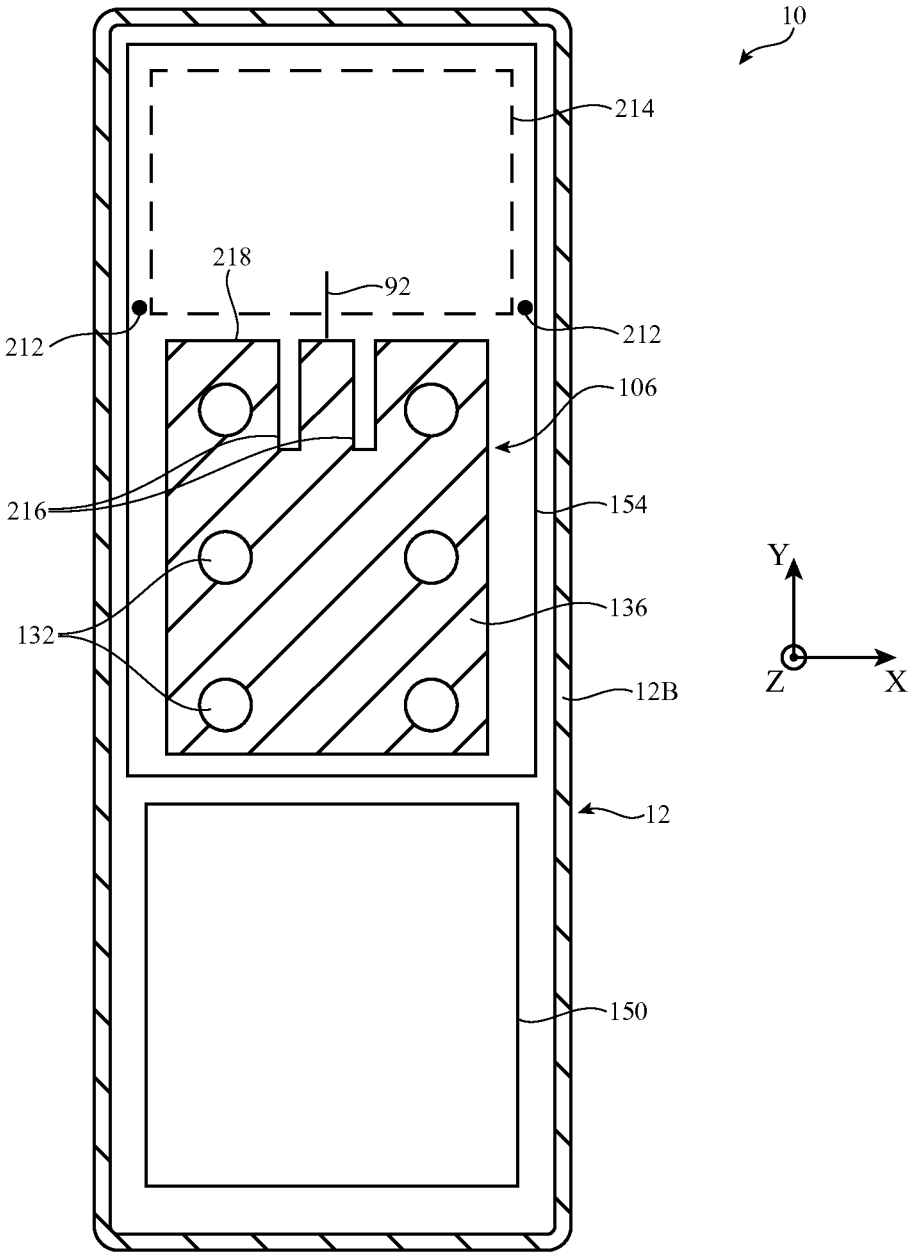
FIG. 9 is a top view of an interior portion of an illustrative electronic device in accordance with an embodiment.

FIG. 9 is a top view of device 10 in a configuration in which glass upper housing layer 12A has been removed to expose internal device structures. As shown in FIG. 9, switches 132 for buttons 14 may be mounted on printed circuit 154. Screws 212 may be used to mount printed circuit 154 to housing 12 and may be used to electrically short metal traces on printed circuit 154 to housing 12. Metal trace 136 may form antenna resonating element 106 (e.g., metal 136 may be a metal layer that is configured to form a rectangular patch antenna as described in connection with antenna resonating element 106 of FIG. 3). Wireless circuitry 34 and other components (e.g., button controller components in storage and processing circuitry 30) may be mounted to the upper and/or lower surfaces of printed circuit 154 in region 214. Touch pad 16 may be mounted in housing 12 in a position that overlaps region 214 (as an example). Battery 150 may be located at an opposing end of housing 12 from region 214.

If desired, slots such as slots 216 may be formed in metal layer 136 to adjust the impedance of antenna resonating element 106. Slots 216 may, for example, run parallel to the longitudinal axis of device 10 and housing 12 (e.g., slots 216 may extend downwards from edge 218 of metal patch 136 as shown in FIG. 9). Adjustments may be made to the widths of slots 216 and/or the lengths of slots 216 or other parameters associated with slots 216 to help ensure that the impedance of the patch antenna resonating element that is formed from metal 136 is not too dissimilar from the impedance of transmission line 92, thereby enhancing antenna performance.

Figure 10:
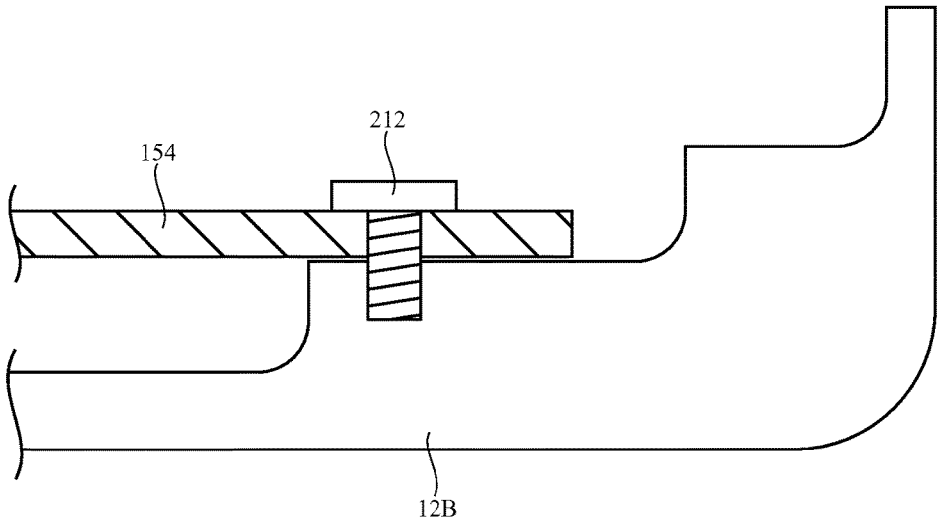
FIG. 10 is a cross-sectional side view of a portion of an illustrative electronic device showing how a screw may be used to mount a printed circuit board to a housing in accordance with an embodiment.
Figure 11:
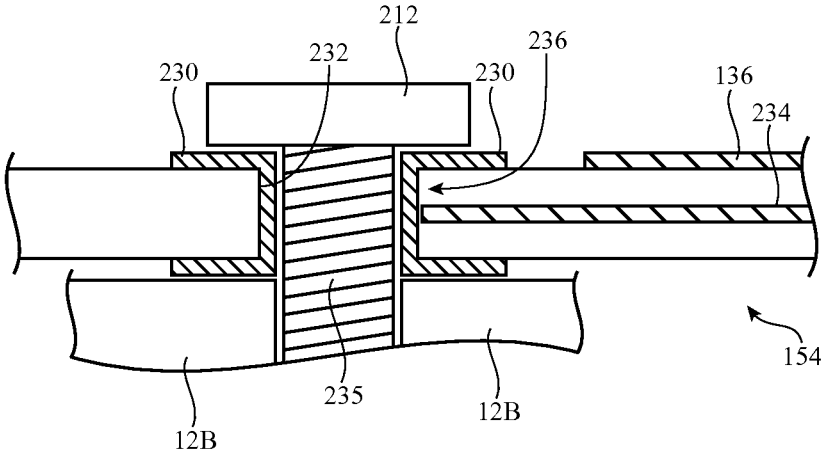
FIG. 11 is a cross-sectional side view of the screw of FIG. 10 in accordance with an embodiment.

As shown in FIG. 10, screws such as screw 212 may be used to short metal traces in printed circuit 154 to metal portions of housing 12 such as housing portion 12B. FIG. 11 shows how printed circuit 154 may have traces such as traces 230 that line the interior of screw-hole openings such as through-hole 232 in printed circuit 154. Shaft 235 of screw 212 may pass through opening 232 and may screw into a threaded opening in housing portion 12B or other threaded structure to short screw 212 to antenna ground 104.

Printed circuit 154 may have opposing upper and lower surfaces. Metal traces 136 on the upper surface of printed circuit 154 may be used in forming antenna resonating element 106. Traces such as traces 234 may be embedded within printed circuit 154 and may, if desired, be shorted to traces 230 and screw 212 at locations such as location 236. Traces 136 and 234 may form parts of a transmission line (e.g., a microstrip transmission line). For example, trace 136 may form a positive signal conductor and trace 234 may form a ground signal conductor. In general, any suitable transmission line structures may be used for forming a transmission line (e.g., transmission line 92) for conveying antenna signals in device 10. The configuration of FIG. 11 is merely illustrative.

Figure 12:
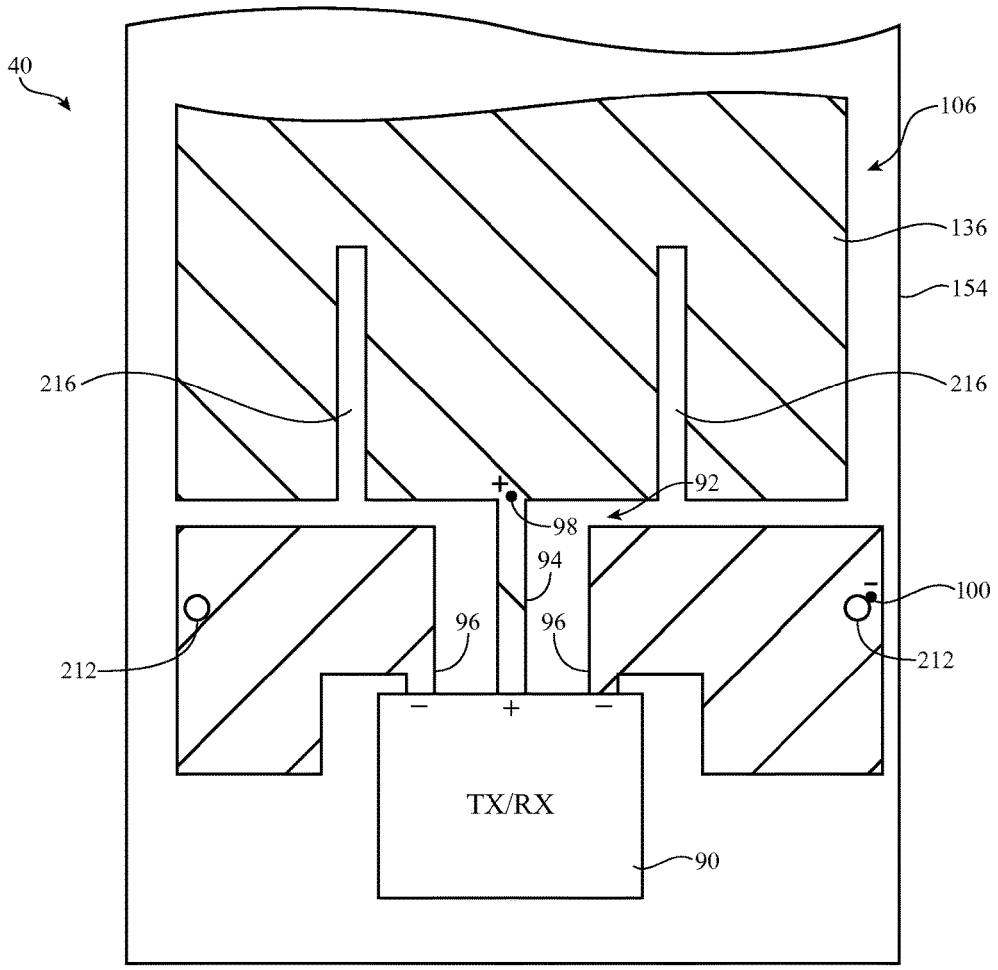
FIG. 12 is a top view of an illustrative printed circuit having an antenna resonating element with slits to make impedance adjustments in accordance with an embodiment.

FIG. 12 is a top view of an illustrative arrangement for coupling radio-frequency transceiver circuitry 90 to antenna resonating element 106 using transmission line 92. As shown in FIG. 12, antenna resonating element 106 of antenna 40 may be formed from metal patch 136. Metal patch 136 may have impedance matching slots such as slots 216 that help to match the impedance of antenna 40 to the impedance of transmission line 92. Transmission line 92 may be formed from positive signal conductor 94 and ground traces 96. Ground traces 96 may be located on one side of the trace that forms positive signal conductor 94 or may be formed on opposing sides of conductor 94 as shown in FIG. 12. If desired, ground traces 96 may be formed under trace 94 (e.g., in a layer of printed circuit 154 that is separated from trace 94 by an intervening substrate dielectric layer).

As shown in FIG. 12, ground traces 96 may be coupled to screws 212 and, through screw 212, may be coupled to metal housing 12B (e.g., rear wall 12R), which serves as antenna ground 104. Screw 212 may serve as antenna ground terminal 100 of FIG. 5. Ground terminal 100 and positive antenna feed terminal 98 form antenna feed for antenna 40. The separation between conductor 94 and conductors 96 may be about three times as large as the width of conductor 94 (as an example).

Figure 13:
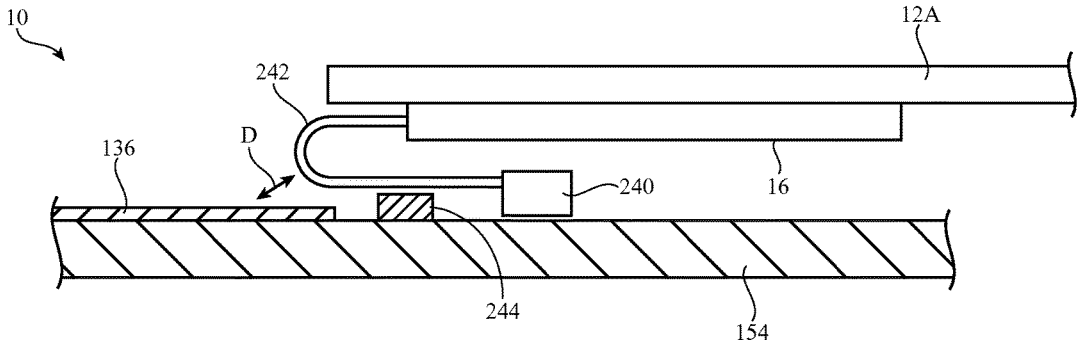
FIG. 13 is a cross-sectional side view of a portion of an electronic device showing how a flexible printed circuit associated with a component may be maintained at an adequate distance from an antenna trace on a printed circuit using a plastic shim in accordance with an embodiment.

It may be desirable to form dielectric structures that help prevent metal in flexible printed circuits and other conductive structures from coming too close to metal traces 136, as this might adversely affect antenna performance. Consider, as an example, the arrangement of FIG. 13. FIG. 13 is a cross-sectional side view of the touch pad portion of device 10. Touch pad 16 may be coupled to a connector on printed circuit 154 such as connector 240 using a flexible printed circuit that is coupled to touch pad (touch sensor) 16 such as flexible printed circuit 242. Flexible printed circuit 242 may contain metal traces. The metal traces may impact antenna performance if distance D separating antenna trace 136 from flexible printed circuit 242 becomes too small. To ensure that the magnitude of separation distance D between metal traces 136 of antenna resonating element 106 and flexible printed circuit 242 does not become too small, a flexible printed circuit guide (support) structure such as shim 244 may be used to prevent flexible printed circuit 242 from moving too close to metal 136. Shim 244 may be formed from molded plastic or other dielectric and may mounted on the surface of printed circuit 154 to help maintain flexible printed circuit 242 at an adequate distance from antenna resonating element 106. Shim 244 may be molded onto printed circuit 154, may be attached to printed circuit 154 using adhesive, screws, or other attachment structures, may be formed from one or more different plastic members, or may be implemented using other suitable support structure arrangements. The illustrative configuration of FIG. 13 is merely presented as an example.

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

a housing having a metal portion that serves as an antenna ground for an antenna;

a printed circuit having a metal layer that forms an antenna resonating element for the antenna; and a capacitive touch sensor;

a glass layer that covers the antenna resonating element and the capacitive touch sensor; and at least one button extending through the glass layer, wherein the metal layer includes an opening that is aligned with the at least one button.

2. The electronic device defined in claim 1 wherein the metal layer has at least one slot.

3. The electronic device defined in claim 1 further comprising a support structure under the printed circuit, wherein the support structure is interposed between the printed circuit and the metal portion of the housing.

4. The electronic device defined in claim 3 wherein the support structure comprises a plastic support structure with an array of recesses.

5. The electronic device defined in claim 1 wherein the metal portion of the housing forms a rear surface for the housing and the glass layer forms an opposing front surface for the housing.

6. The electronic device defined in claim 1 further comprising a screw that couples a ground trace on the printed circuit to the metal portion of the housing.

7. The electronic device defined in claim 1 further comprising:

a flexible printed circuit; and a dielectric structure on the printed circuit that prevents the flexible printed circuit from coming too close to the metal layer.

8. The electronic device defined in claim 7, wherein the dielectric structure comprises a plastic shim and the capacitive touch sensor is coupled to the flexible printed circuit.

9. The electronic device defined in claim 8 wherein the metal portion of the housing forms a rear surface for the housing and the glass layer forms an opposing front surface for the housing.

10. The electronic device defined in claim 1, further comprising:

control circuitry that is coupled to the at least one button through at least one inductor.

11. A remote control, comprising:

a housing having a metal portion that serves as an antenna ground for an antenna;

a printed circuit having a metal layer that forms an antenna resonating element for the antenna;

a capacitive touch sensor;

a glass layer that covers the antenna resonating element and the capacitive touch sensor; and at least one button extending through the glass layer, wherein the metal layer includes an opening that is aligned with the at least one button.

12. The remote control defined in claim 11 wherein the glass layer has an array of openings and wherein the at least one button comprises a plurality of buttons respectively in the array of openings.

13. The remote control defined in claim 11, wherein the antenna resonating element comprises a patch antenna resonating element.

14. The remote control defined in claim 11, further comprising:

a switch mounted on the printed circuit at the opening of the metal layer, wherein the switch is aligned with the at least one button and the opening of the metal layer.

15. The remote control defined in claim 14, wherein a transmission line couples the metal layer to radio-frequency transceiver circuitry.

16. The remote control defined in claim 11, wherein the printed circuit includes a substrate, wherein the antenna resonating element is interposed between the substrate and the glass layer.

17. The remote control defined in claim 16, wherein the antenna resonating element is interposed between the substrate and a first portion of the glass layer, the capacitive touch sensor is interposed between a second portion of the glass layer and the substrate, and the first and second portions of the glass layer are nonoverlapping.

18. A remote control, comprising:

a housing having a metal portion that serves as an antenna ground for an antenna;

a printed circuit having a metal layer that forms an antenna resonating element for the antenna, the antenna resonating element comprising a patch antenna resonating element;

a capacitive touch sensor located at one end of the housing;

a glass layer that covers the antenna resonating element and the capacitive touch sensor; and a plurality of buttons extending through a first portion of the glass layer, wherein the printed circuit includes a substrate, the metal layer is interposed between the substrate and the first portion of the glass layer, the capacitive touch sensor is interposed between a second portion of the glass layer and the substrate, and the first and second portions of the glass layer are nonoverlapping.

* * * * *